US006367917B1

(12) United States Patent
Zaba

(10) Patent No.: US 6,367,917 B1
(45) Date of Patent: Apr. 9, 2002

(54) CONTINUOUS INKJET PRINTER, PRINTHEAD, AND METHOD OF MANUFACTURING ELECTRODES

(75) Inventor: Jerzy Marcin Zaba, Cambridge (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 09/331,492

(22) PCT Filed: Dec. 18, 1997

(86) PCT No.: PCT/GB97/03498

§ 371 Date: Jun. 21, 1999

§ 102(e) Date: Jun. 21, 1999

(87) PCT Pub. No.: WO98/28147

PCT Pub. Date: Jul. 2, 1998

(30) Foreign Application Priority Data

Dec. 23, 1996 (GB) ..... 9626686

(51) Int. Cl.[7] ..... B41J 2/09; B41J 2/125; B05D 5/12

(52) U.S. Cl. ..... 347/77; 347/81; 427/97

(58) Field of Search ..... 347/80, 81, 77, 347/76, 19, 6; 427/97, 98, 123; 29/890.1

(56) References Cited

U.S. PATENT DOCUMENTS 3,953,860 A * 4/1976 Fujimoto et al. ..... 347/81
4,870,541 A * 9/1989 Cole ..... 361/328
6,079,100 A * 7/2000 Farquhar et al. ..... 427/97 X

OTHER PUBLICATIONS

Brady, M. J.; Kuhn, L.; Lane, R.; and Sippel, D., "Self –Purging Deflector–Gutter for Ink Jet Arrays", IBM Technical Disclosure Bulletin, vol. 18, No. 4, p. 1236, Sep. 1975.*

* cited by examiner

*Primary Examiner*—David F. Yockey
(74) *Attorney, Agent, or Firm*—Robert F. I. Conte; Lee, Mann, Smith, McWilliams, Sweeney & Ohlson

(57) ABSTRACT

E1 A CIJ printhead includes a droplet deflector electrode having one or more windows formed therein, and a phase or velocity detector electrode disposed within the window. A method of forming the electrodes by plating multiple conductive and dielectric layers is also disclosed.

9 Claims, 4 Drawing Sheets

CONTINUOUS INKJET PRINTER, PRINTHEAD, AND METHOD OF MANUFACTURING ELECTRODES

FIELD OF INVENTION

The present invention relates to continuous inkjet (CIJ) printers and, more particularly, to CIJ printers of the multi-nozzle type.

BACKGROUND ON THE INVENTION

Multi-nozzle continuous inkjet printers have been developed in order to provide high quality, high speed printing. A row of inkjet nozzles at very close spacings are provided and individual streams of ink issue from each of the nozzles continuously in use, being broken up into individual droplets automatically. The individual droplets are charged appropriately to cause them to be printed or else deflected into a gutter. Printers of this type are described, for example, in U.S. Pat. Nos. 4,613,871 and 4,427,986. the printers described in these specifications are of the type generally known as binary continuous multi-jet.

In order to control the printing process accurately, it is known to detect both the velocity of the droplets being emitted from the droplet generator nozzles and to determine the phase of droplet charging with respect to droplet generation by means of electrodes which extend transverse to the path of the droplets.

The phase detection and velocity detection electrodes, as they are known, can be disposed between the charge electrodes and the deflection electrode or electrodes. However, it is important to ensure that, for accuracy of phase and velocity detection, the phase and velocity detector electrodes are themselves very accurately positioned with respect to the charge electrode.

SUMMARY OF THE INVENTION

The present invention is aimed at ensuring accurate location of the phase detector and/or velocity detector electrodes in a continuous inkjet printer.

According to the present invention a multi-jet CIJ printer has a deflection electrode having a window formed therein, a phase detector or velocity detector electrode being disposed within the window.

Preferably, when forming a pair of detectors within the envelope of the deflection electrode, the phase detector and velocity detector electrode are formed, by a deposition process in which a non-conductive dielectric plate, preferably formed of alumina, is pre-drilled with a pair of holes spaced apart on the surface of the plate and a conductive material, for example, gold, silver or other suitable conductive metal or composite is plated through the holes. Thereafter, one side of the dielectric plate is plated with a conductive layer which is not connected with the plating through the holes, the interior of the holes being filled through with a dielectric material such as glass to create a liquid tight barrier, and a pair of dielectric layers, one corresponding to each of the detectors, are laid down, each of the dielectric layers surrounding a respective one of the holes through the plate. On top of these dielectric layers the detectors are plated, for example, using gold, silver or other suitable conductive material, each of the conductive layers forming the detectors being connected to the conductive plating through the respective hole. Further dielectric layers are laid over the detectors and then the face of the plate is plated with a conductive material, to provide the deflection electrode, with a pair of windows being left above each of the detector areas before the detector areas are partly exposed within the windows.

On the other face of the dielectric plate a pair of conductive connector pads may be formed in communication with the plated conductive layers through the holes and a conductive screen layer is plated onto the dielectric substrate around, but not in contact, with the conductive pads. A dielectric covering layer is then printed over the conductive layer with a pair of small windows being left at the location of each of the conductive pads, one window of each pair being positioned directly over the conductive pad and the other spaced from it so as to lie over the conductive screen layer. This enables connection of the inner core to the respective detector and the shield layer of a coaxial conductor to the shield (deflection electrode), with the conductor lying substantially parallel to the face of the plate.

Locating the phase detector and/or velocity detector electrode or electrodes within the face of the deflection electrode not only achieves a compact design, but also, since the deflection electrode is located accurately with respect to the charge electrodes, achieves corresponding accuracy of location of the phase detector and/or velocity detector electrodes with respect to the charge electrodes.

BRIEF DESCRIPTION OF THE DRAWINGS

One example of a deflection electrode with phase detector and velocity detector electrodes formed in the face thereof will now be described with reference to the accompanying drawings in which.

DETAILED DESCRIPTION OF THE INVENTION

Figure 1:
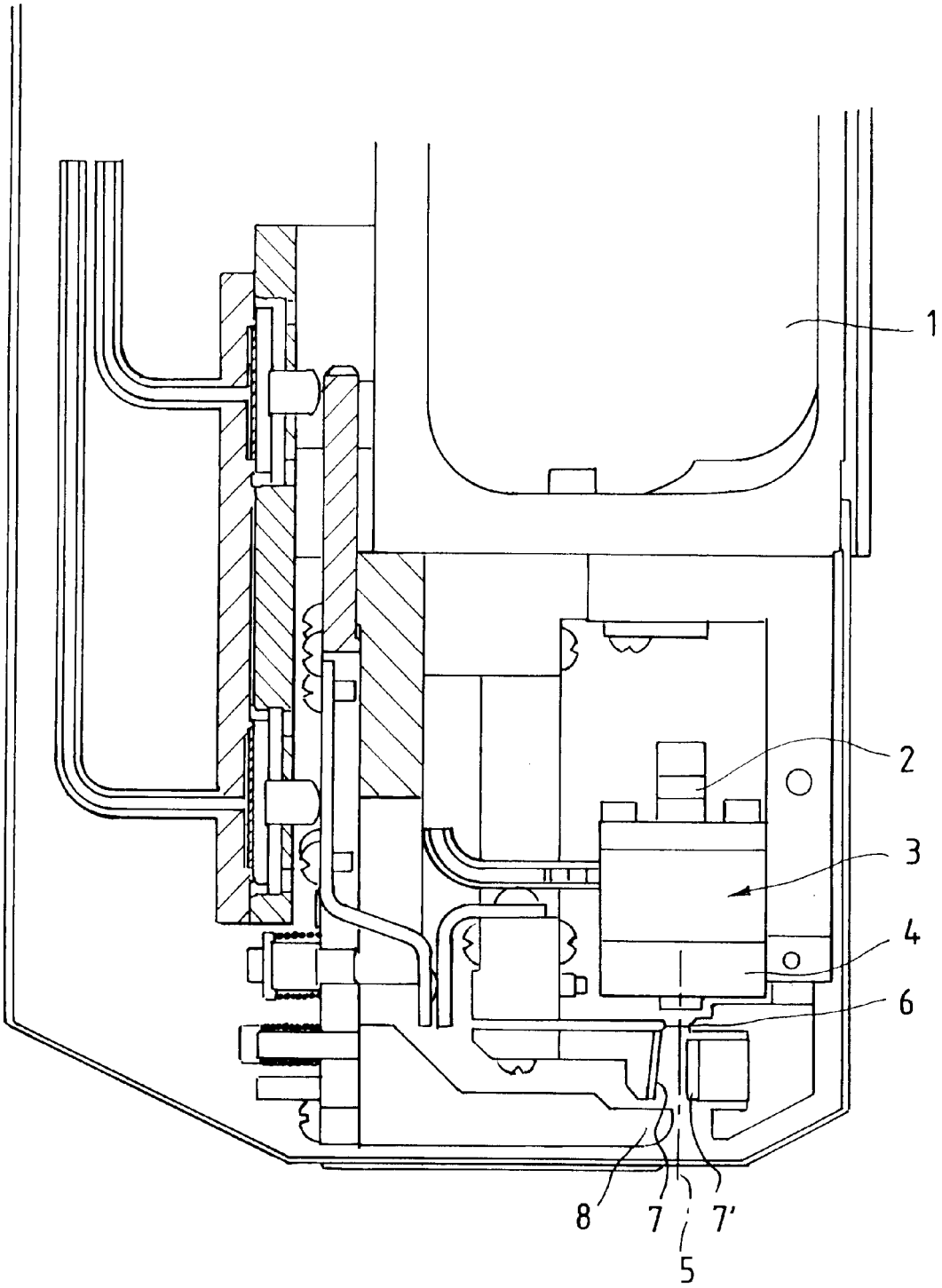
FIG. 1 is a side view of the print head of a multi-nozzle CIJ printer as described in our EP-A-0780231; and, FIGS. 2 to 8 illustrate various stages in the manufacture of the integrated phase detector and velocity detector electrodes.
Figure 2:
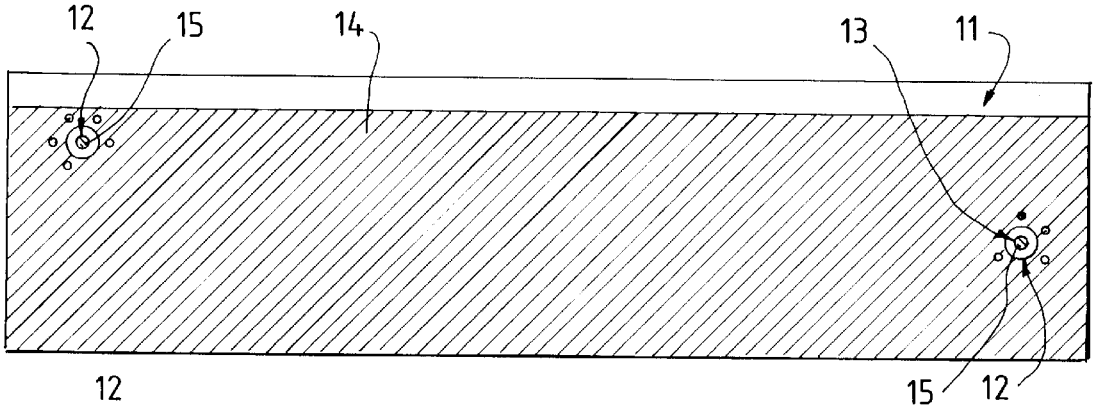
Figure 3:
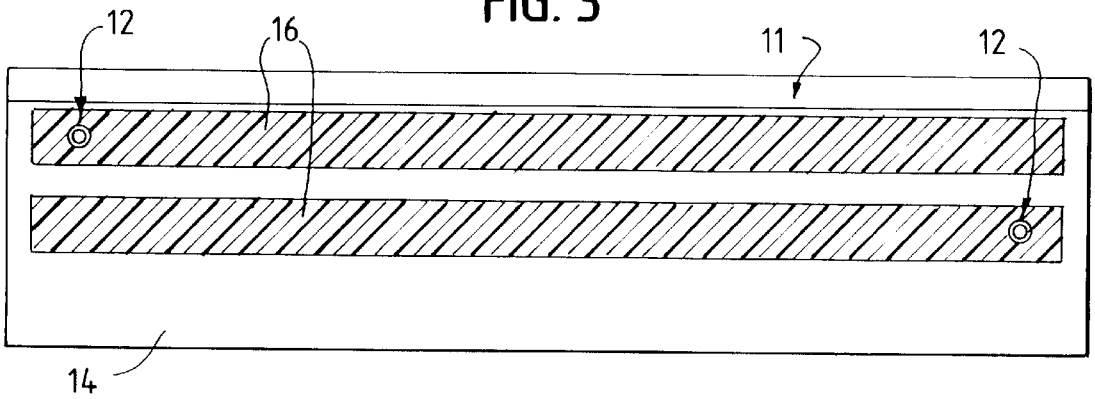
Figure 4:
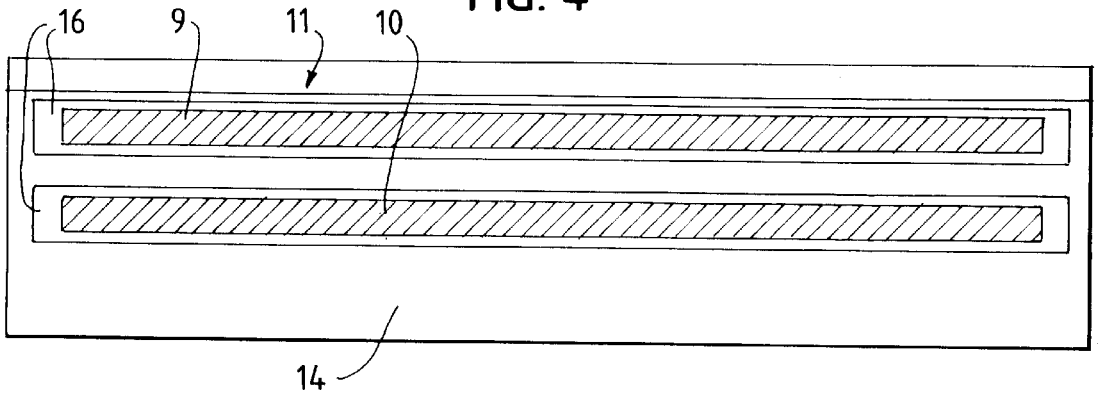
Figure 5:
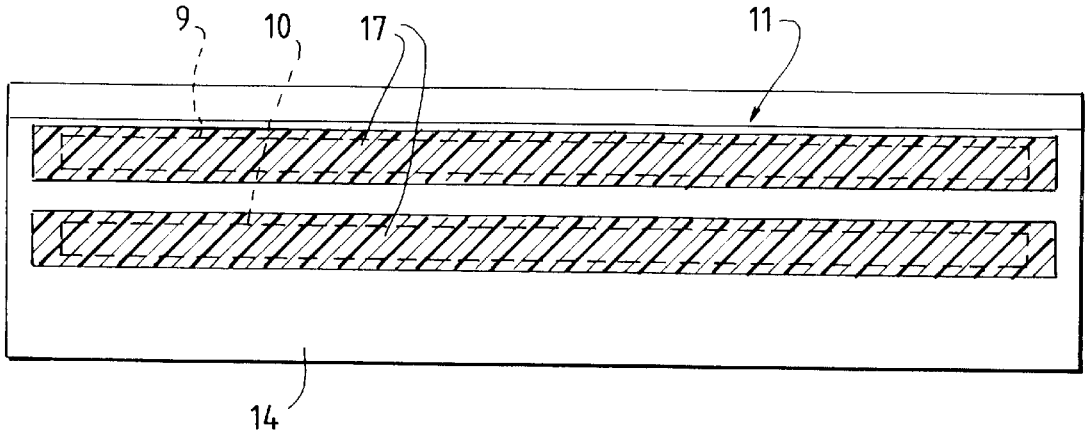
Figure 6:
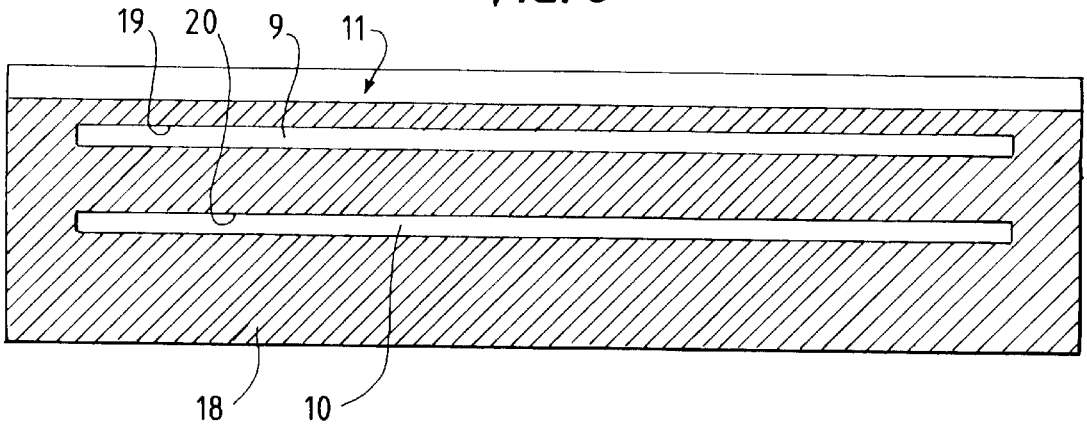
Figure 7:
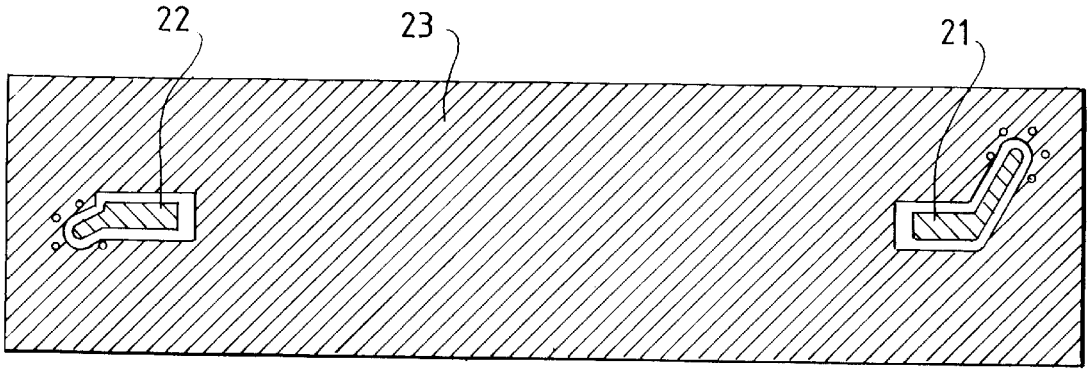
Figure 8:
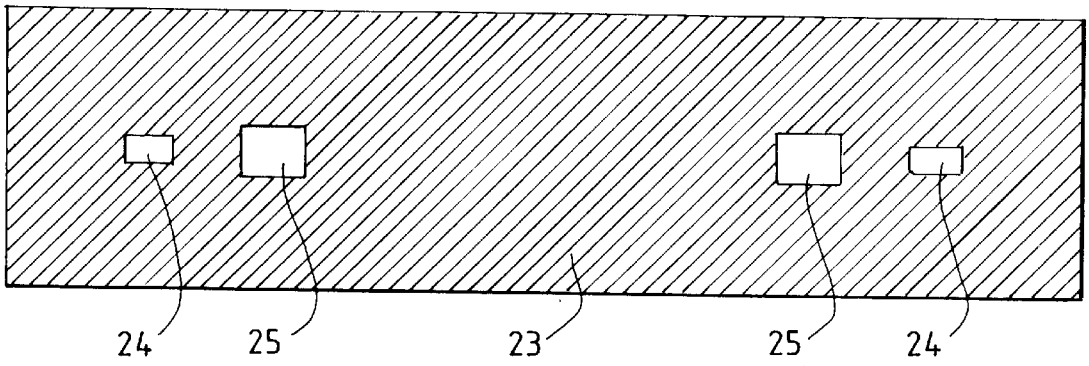

The printhead shown in FIG. 1 is described in more detail in our EP-A-0780231. Since not all the features shown in FIG. 1 are relevant for a description of the present invention only the primary features will be referenced and described.

The printhead has an electronics sub-system 1 by means of which are controlled the piezoelectric oscillator 2 forming part of a droplet generator 3 which has a nozzle plate 4 from which, in use, issue plural streams 5 of ink. The closely spaced nozzles are arranged in a row normal to the plane of the drawing. The streams of ink break up into individual droplets which pass respective charge electrodes 6 also arranged in a row in the same direction, where they are selectively charged and then passed between a pair of deflection electrodes 7, 7' which establish, in use, an electric field by means of which charged droplets are deflected from their straight-line path into a gutter 8. Formed in the face of the deflection electrode 7 are a phase detector electrode and velocity detector electrode (neither of which is shown in FIG. 1) which are used to detect the charge applied to droplets by the charge electrode 6 and the speed of the droplets respectively.

FIGS. 2 to 8 illustrate the phase detector electrode and velocity detector electrode and their manufacture in more detail.

The phase detector 9 and the velocity detector electrode 10 are formed, together with the deflection electrode 7, by a deposition process, in which, as a first step (see FIG. 2) a non-conductive rectangular dielectric plate 11, preferably formed of alumina and pre-drilled with a pair of holes 12 spaced apart on the surface of the plate, has a conductive material 13, for example, gold, silver or other suitable conductive metal or composite, plated through the holes 12. Thereafter (also FIG. 2), one side of the dielectric plate 11 is screen printed or otherwise plated with a conductive layer 14 which provides a shield in use, and which is not connected with the plating 13 through the holes. The interior of the holes is then filled through with a dielectric material 15 such as glass to seal them against liquid.

Next (see FIG. 3), on top of the conductive layer 14, a pair of dielectric layers 16, one corresponding to each of the detectors, are laid down, each of the dielectric layers surrounding a respective one of the holes 12 through the plate 11. On top of these dielectric layers 16, the detectors 9, 10 are then screen printed or otherwise plated (see FIG. 4), for example, using gold, silver or other suitable conductive material, each of the conductive layers forming the detectors 9,10 being connected to the conductive plating 13 through the respective hole 12.

Further dielectric layers 17 are then (see FIG. 5) laid down over the detectors, and then (see FIG. 6) the major part of the face of the plate is plated with a conductive material 18, with a pair of "windows" 19,20 being left above each of the detector areas 9,10 before the detector areas are partly exposed within the "windows".

On the other face of the dielectric plate 11 (see FIG. 7) a pair of conductive connector pads 21,22 are formed in communication with the plated conductive layers 13 through the holes 12 and a further conductive screen layer 23 is plated onto the dielectric substrate around, but not in contact with, the conductive pads 21,22. A dielectric covering layer 24 is then printed over the conductive layer 23 with a pair of small windows 24,25 being left at the location of each of the conductive pads 21,22, one window 24 of each pair being positioned directly over the conductive pad 21,22 and the other pad spaced from it so as to lie over the conductive screen layer 23. This enables connection of the inner core and the shield layer respectively of a coaxial conductor (not shown) to be made to the conductive pad 21,22 and shield 23 respectively, with the conductor lying substantially parallel to the face of the plate. This provides a secure shielded connection to each of the detectors 9,10 in a simple manner which does not occupy significant space on the side of the deflector plate opposite the detectors 7,9,10.

What is claimed is:

1. A method of manufacturing a phase or velocity detector electrode and a deflection electrode for a CIJ printhead, comprising the steps of:

a) providing a non-conductive dielectric substrate;

b) providing at least one hole through the substrate;

c) plating a conductive material, through the at least one hole;

d) plating one side of the dielectric substrate with a conductive layer in such manner as to avoid connection with the plating through the at least one hole;

e) filling the interior of the at least one hole with a dielectric material to create a liquid tight barrier;

f) forming a dielectric layer surrounding the at least one hole;

g) plating, on top of the dielectric layer, a conductive material to form at least one detector, the at least one detector being connected to the conductive plating through the at least one hole;

h) providing a further dielectric layer over the at least one detector;

i) plating a face of the substrate with a conductive material to provide a deflection electrode, leaving a window above the at least one detector; and j) partly exposing the at least one detector within the window.

2. A method according to claim 1, further comprising the steps of:

k) forming at least one conductive connector pad on another face of the dielectric substrate in communication with the plated conductive layer through the at least one hole;

l) plating a conductive screen layer onto the dielectric substrate around, but not in contact with, the at least one conductive pad;

m) forming a dielectric covering layer over the conductive layer with a pair of windows being left at a location of the at least one conductive pad, one window of the pair being positioned directly over the at least one conductive pad and the other being spaced from said at least one conductive pad so as to lie over the conductive screen layer.

3. A method according to claim 2, further comprising the steps of:

n) connecting an inner core of a coaxial conductor to the at least one conductive pad and hence to the at least one detector, and o) connecting a shield layer of the coaxial conductor to the screen layer, with the coaxial conductor lying substantially parallel to the substrate.

4. A method according to claim 3, wherein said at least one detector comprises a pair of detectors and said at least one hole comprises a pair of holes.

5. The method according to claim 2, wherein said at least one conductive pad comprises a pair of conductive pads.

6. A method according to claim 2, wherein said at least one detector comprises a pair of detectors and said at least one hole comprises a pair of holes.

7. A method according to claim 1, wherein said at least one detector comprises a pair of detectors and said at least one hole comprises a pair of holes.

8. A multi-jet continuous inkjet printhead comprising:

a dielectric substrate, an ink droplet deflector electrode connected to said dielectric substrate, said ink drop deflector electrode disposed within said second window and connected to said droplet deflector electrode, and a phase detector electrode disposed within said first window and connected to said droplet deflector electrode.

9. A continuous inkjet printer comprising:

a printhead, said printhead having a dielectric substrate and an ink droplet deflector electrode connected to said dielectric substrate, said ink droplet deflector electrode having a first and second window, a phase detector electrode disposed within said first window and connected to said droplet deflector electrode, and a velocity detector electrode disposed within said second window and connected to said droplet deflector electrode.

* * * * *